United States Patent [19]

Augros

[11] 4,262,813

[45] Apr. 21, 1981

[54] BOTTLE CLOSURE

[75] Inventor: Jacques Augros, Villiers le Bel, France

[73] Assignee: Arts et Techniques Nouvelles, Paris, France

[21] Appl. No.: 85,211

[22] Filed: Oct. 16, 1979

[30] Foreign Application Priority Data

Oct. 17, 1978 [FR] France ..... 78 29562

[51] Int. Cl.[3] ..... B65D 41/02

[52] U.S. Cl. ..... 215/12 R; 211/76; 215/200

[58] Field of Search ..... 211/76, 84; 215/200, 215/293, 316, 12 R

[56] References Cited

U.S. PATENT DOCUMENTS

| | | | |
|---|---|---|---|
| 426,811 | 4/1890 | Henkel | 211/76 |
| 709,819 | 9/1902 | Hicks | 211/76 |
| 1,203,202 | 10/1916 | Kinsella | 211/76 |
| 2,267,179 | 12/1941 | Wells | 215/12 R |
| 2,292,651 | 8/1942 | Olevin | 211/76 |
| 2,710,694 | 6/1955 | Carr | 211/76 |
| 2,751,764 | 6/1956 | Hudes . | |

FOREIGN PATENT DOCUMENTS 881689 2/1942 France .

*Primary Examiner*—Donald F. Norton
*Attorney, Agent, or Firm*—Irvin A. Lavine

[57] ABSTRACT

Device for closing off the opening of a container or bottle consisting of a member or frame inside which is placed the bottle, a first cap of the frame closing off the opening of the bottle while a second cap, which presses against the bottom of the bottle, urges the said opening against the said first cap.

8 Claims, 2 Drawing Figures

BOTTLE CLOSURE

The invention relates to a new closing device for a container or a bottle where no threaded neck is provided for a screw cap.

It is therefore the object of the invention to provide a device for closing the opening of a container or bottle, comprising a support member inside which is mounted the bottle, and a sealing projection internal of the said member which comes into position on the opening whilst the bottom of the container, opposite the said opening, is resiliently urged by the portion of the said member on which the said bottom rests.

Figure 2:
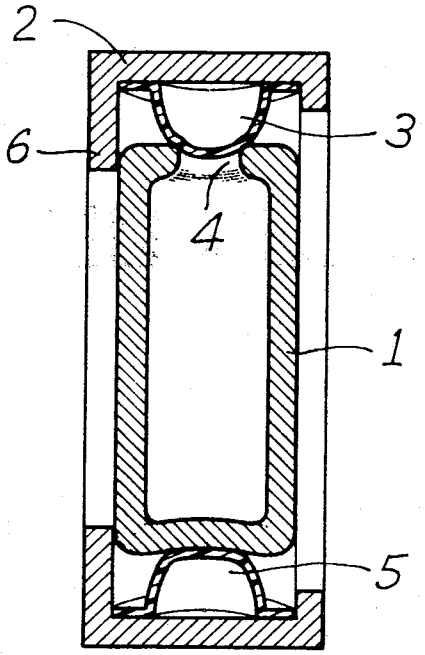
Figure 1:
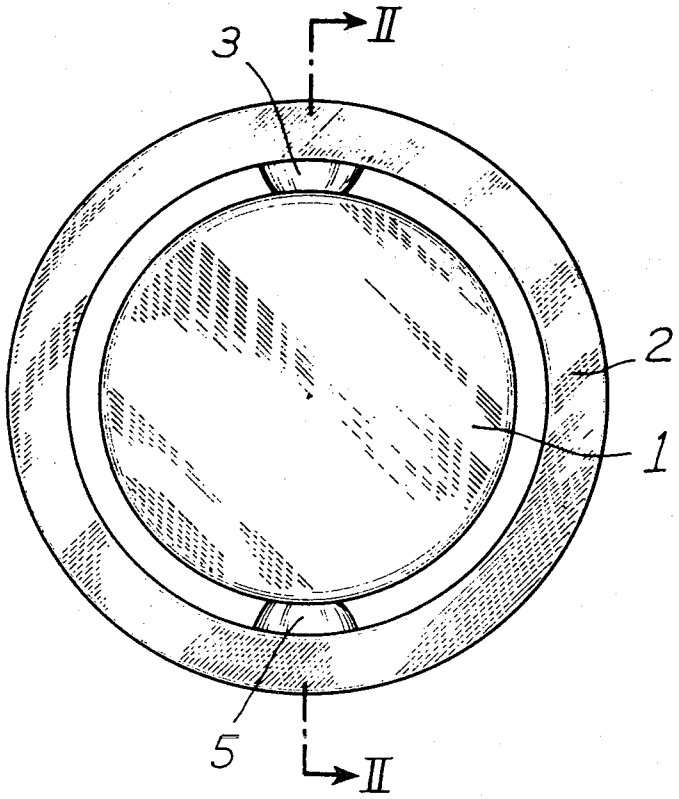

Other characteristics will emerge from the following description, given by way of example and non-restrictively, reference being made to the accompanying drawings in which:

FIG. 1 is a side view of a bottle fitted with the closing device according to the invention, FIG. 2 is a cross-section along line II—II of FIG. 1.

According to the invention illustrated in the drawing, the closing device intended for the bottle 1 which is shaped as a portion of cylinder, is constituted by a ring-shaped frame 2 in which is mounted the bottle; to this effect, the same frame 2 is provided on the inside with a cap 3 pressing against the orifice 4 of the bottle, which orifice is urged against said cap by a second resilient cap 5 provided between the frame and the bottle, and diametrically opposed to the sealing cap 3.

The frame 2 comprises a peripheral inside flange 6 serving as a means to stop the bottle in position inside the frame and to prevent it from pivoting between the caps 3 and 5 acting as pivots.

In the example shown, the cap 3 is applied against the orifice by the pressure coming from the cap 5, but the bottle could just as well press directly against the frame, the resilient deformation of the latter maintaining the cap 3 pressed against the orifice of the bottle.

It is understood that the frame and the bottle may be of any shape, as means can be provided to connect them in pivotal manner, thereby making them easy to use.

The invention is not limited to the embodiments shown and described herein, and various modifications may be made thereto without departing from its scope or its spirit.

What is claimed is:

1. In combination:

a single bottle having an opening and a bottom opposite the opening:

a ring shaped frame, said bottle being within said frame;

said ring shaped frame having on the inside thereof a sealing projection engaging said opening, and having a resilient projection diametrically opposite said sealing projection for urging said bottle against said sealing projection.

2. The combination of claim 1, said frame comprising stop means for engagement by the bottle when the bottle is placed in said frame by lateral movement of said bottle relative to said frame upon insertion of said bottle into said frame.

3. The combination of claim 2, said stop means comprising means for preventing said bottle from pivoting between said sealing projection and said resilient projection as pivots.

4. The combination of claim 2 or 3 wherein said stop means comprises a peripheral inside flange.

5. The combination of claim 1, said sealing projection being resilient.

6. The combination of claim 1, said bottle being cylindrical and having the opening in the annular wall thereof.

7. The combination of claim 6, wherein said projections are of substantially equal radial extent, the axis of the bottle being substantially coincident with the axis of the ring shaped frame.

8. The combination of claim 6 or 7, and annular stop means on said frame extending radially inwardly for engagement by said bottle.

* * * * *